United States Patent [19]

Yamada et al.

[11] Patent Number: 4,477,547

[45] Date of Patent: Oct. 16, 1984

[54] METHOD FOR MAKING COMPLEX LAYER TYPE LITHOGRAFIC PRINTING PLATE

[75] Inventors: Jun Yamada; Takao Senga; Shigeyoshi Suzuki, all of Nagaokayo, Japan

[73] Assignee: Mitsubishi Paper Mills, Ltd., Tokyo, Japan

[21] Appl. No.: 455,998

[22] Filed: Jan. 6, 1983

[30] Foreign Application Priority Data

Jan. 7, 1982 [JP] Japan ..... 57-1322

[51] Int. Cl.[3] ..... G03C 3/00; G03G 13/28

[52] U.S. Cl. ..... 430/14; 430/18; 430/58; 430/96; 430/49

[58] Field of Search ..... 430/14, 18, 49, 58, 430/59, 96

[56] References Cited

U.S. PATENT DOCUMENTS

| | | | |
|---|---|---|---|
| 3,816,118 | 6/1974 | Byrne | 430/56 |
| 3,895,944 | 7/1975 | Wiedemann et al. | 430/59 |
| 3,981,728 | 9/1976 | Jones | 430/84 |
| 4,066,453 | 1/1978 | Lind et al. | 430/49 |
| 4,435,491 | 3/1984 | Kitamura et al. | 430/49 |

FOREIGN PATENT DOCUMENTS

| | | | |
|---|---|---|---|
| 2917486 | 11/1979 | Fed. Rep. of Germany | 430/49 |
| 57-142643 | 9/1982 | Japan | 430/58 |
| 1337228 | 11/1973 | United Kingdom | 430/58 |
| 1343671 | 1/1974 | United Kingdom | 430/58 |

*Primary Examiner*—John E. Kittle
*Assistant Examiner*—José G. Dees
*Attorney, Agent, or Firm*—Cushman, Darby & Cushman

[57] ABSTRACT

Disclosed is a method for making a complex layer type lithographic printing plate by forming a toner image on a printing original plate having organic electrophotographic photosensitive layer by electrophotographic process and treating non-image area other than the toner image area with an etching solution mainly composed of an alcohol solvent and/or an alkali solvent, said photosensitive layer being a complex layer type photosensitive layer which comprises a charge carrier generating layer comprising a charge carrier generating substance and a binder mainly composed of a polyamide resin soluble in alcohol solvent and a high molecular substance having compatibility with said resin and having a group soluble in alcohol solvent and/or alkali solvent and a charge carrier transport layer containing a high molecular substance having a group soluble in an etching solution mainly composed of alcohol solvent and/or alkali solvent and thereafter treating non-image area other than the toner image area with the etching solution.

8 Claims, No Drawings

METHOD FOR MAKING COMPLEX LAYER TYPE LITHOGRAFIC PRINTING PLATE

BACKGROUND OF THE INVENTION

This invention relates to a method for making a complex layer type lithographic printing plate which utilizes electrophotographic complex layer type photosensitive material and more particularly to a method for making a complex layer type lithographic printing plate wherein a charge carrier generating layer is soluble in an etching solution mainly composed of alcohol solvent and/or alkali solvent.

Hitherto, there have been used electrophotographic photosensitive materials which comprise a conductive support on which is provided, as a single layer, a photosensitive layer comprising charge-transport complexes of selenium, zinc oxide or polyvinyl carbazole and trinitrofluorenone as a photoconductor. However, recently, the so-called function-separated type electrophotographic complex layer type photosensitive materials where the function of carrier generation and that of charge carrier transport in the photosensitive layer are separated in two layers have been proposed and substances which have not been used because of low photosensitivity in the conventional single-layer photosensitive materials or novel substances which have not been known to have photosensitivity are used as charge carrier generating substances or charge carrier transport substances in electrophotographic complex layer type photosensitive materials. These complex layer type photosensitive materials are higher in sensitivity than said single-layer photosensitive materials.

Generally, the charge carrier generating layer of these electrophotographic complex layer type photosensitive materials is prepared by vacuum deposition of charge carrier generating substances per se or dispersing them in a suitable binder and making the dispersion into a thin layer. When the charge carrier generating substance is vacuum deposited, adhesion to a support or a charge carrier transport layer is low or even if there is no problem in the adhesion, solubility of the charge carrier generating layer in an etching solution mainly composed of alcohol solvent and/or alkali solvent is low. Thus, this cannot be applied to lithographic printing plates. On the other hand, when the charge carrier generating substance is dispersed in a binder, the binders are often insoluble in said etching solution and it is difficult to remove non-image areas. Even if a binder soluble in said etching solution is singly used, a long time is required for dissolving the binder or sensitivity is decreased. Thus, this cannot be applied to lithographic printing plates.

SUMMARY OF THE INVENTION

According to this invention, as a result of researches on binders of charge carrier generating layers in an attempt to solve the above mentioned problems, it has become possible to apply electrophotographic complex layer type photosensitive materials to lithographic printing plates.

That is, this invention relates to a method for making a complex layer type lithographic printing plate which comprises producing toner images on an original plate having organic electrophotographic photosensitive layer by electrophotographic process and then treating non-image area other than the toner image area with an etching solution mainly composed of an alcohol solvent and/or alkali solvent, characterized in that said photosensitive layer is a complex layer type photosensitive layer comprising charge carrier generating layer prepared by coating a coating solution containing a charge carrier generating substance and a binder mainly composed of a polyamide resin soluble in an alcohol solvent and a high molecular substance having a group soluble in said etching solution and having compatibility with said resin and a charge carrier transport layer prepared by coating a coating solution containing a charge carrier transport substance and a high molecular substance having a group at least soluble in said etching solution, these layers being provided in this order.

The charge carrier generating layer and the charge carrier transport layer will be referred to as CG layer and CT layer hereinafter, respectively.

DESCRIPTION OF THE INVENTION

This invention will be further explained in detail.

The complex layer type lithographic printing plate of this invention utilizes electrophotographic complex layer type photosensitive material and is made by providing on a conductive support a CG layer and a CT layer in this order.

The CG layer is prepared by coating a coating solution containing the charge carrier generating substance and the binder. The binder contains mainly a polyamide resin soluble in an alcohol solvent and a high molecular substance having a group soluble in the etching solution, namely, alcohol solvent and/or alkali solvents.

As the polyamide resin soluble in alcohol solvents, there may be used various copolymer nylons soluble in alcohol solvents such as methanol, ethanol, etc. as disclosed in, for example, Japanese Patent Unexamined Publication (Kokai) No. 25638/77. Examples of these nylons are 6/6,6-nylon (copolymer of 6-nylon monomer and 6,6-nylon monomer), 6/11 nylon, 6/6, 6/11 nylon, 6,6/11 nylon, etc. As commercially available resins, there may be used, e.g., type-5013B, type-5033B, type $C_6$-EH, manufactured by Ube Industries, Ltd., CM4000 and CM8000 manufactured by Toray Industries, Ltd., Ultramide IC and Ultramide LR102 manufactured by BASF AG.

It has been known that electrophotographic complex layer type photosensitive materials having a CG layer prepared by coating a coating solution containing a charge carrier generating substance and a polyamide resin as a binder are superior in sensitivity to those which use as a binder, for example, polyester resins, acrylic resins, alkyd resins, polycarbonate resins, phenol resins, polyvinyl acetate resins, vinyl chloride resins, etc. and they have less residual potential and are especially excellent in interlaminar bonding. These have been used as electrophotographic complex layer type photosensitive materials for office duplicators. However, when a complex layer type photosensitive material having a CG layer which uses polyamide resins as binder is applied to lithographic printing plates, even if CT layer is soluble in said etching solution, the polyamide resins require a long time to be dissolved in alcohol solvents and besides are insoluble in alkali solvents and therefore only the CG layer remains by treatment with said etching solution and there occur scumming in non-image areas at printing. Thus, clear prints cannot be obtained and such photosensitive materials cannot be applied to lithographic printing plates.

According to this invention, the above mentioned defects have been improved by using as the binder for the CG layer a polyamide resin and a high molecular substance having compatibility with said polyamide resin and having a group soluble in alcohol solvents and/or alkali solvents to accelerate dissolution in said etching solution.

As examples of the high molecular substances compatible with polyamide resins and having a group souble in alcohol solvents, mention may be made of, for example, styrene-maleic anhydride copolymer, maleic acid ester resin, vinyl acetate-crotonic acid copolymer, vinyl acetate-maleic anhydride copolymer, polyacrylic acid resin, (meth)acrylic acid-(meth)acrylic acid ester copolymer, styrene-(meth)acrylic acid copolymer, phthalic acid-maleic anhydride copolymer, etc. which have acid anhydride group or carboxylic acid group, high molecular substances having sulfonic acid group or sulfonimide group, etc. By adding these high molecular substances having a group soluble in alcohol and alkali solvents to the binder for CG layer, the CG layer can be rapidly dissolved in said etching solution and this invention is thus accomplished.

Amount of the high molecular substances having a group soluble in alcohol solvents and alkali solvents to said polyamide resins has no special limitation. When the high molecular substances have a large amount of said soluble group, amount of the substances may be small while when they have a small amount of the group, amount of them may be large. Preferred amount of the high molecular substances is 5 to 70% by weight.

The charge carrier generating substances used in the CG layer of this invention include various organic pigments known as organic photoconductors and various dyes known as sensitizing dyes. As examples of the organic pigments, mention may be made of metal-free and metal-containing phthalocyanine pigments, monoazo and dis-azo pigments, quinacridone pigemnts, benzimidazole pigments, indigo pigments, polycyclic quinone pigments, perylene pigments, quinoline pigments, cyanine pigments, pyrylium pigments and as examples of the dyes, mention may be made of triphenylmethane dyes such as Methyl Violete, Crystal Violet, Ethyl Violet, Victoria Blue, etc., thiazine dyes such as Methylene Blue, etc., quinone dyes such as quinizarine, etc., xanthene dyes such as Rhodamine B, etc., cyanine dyes, sensitizing dyes such as pyrylium salts, thiapyrylium salts, benzopyrylium salts and sensitizing dyes disclosed in Japanese Patent Unexamined Publication (Kokai) No. 79541/80.

Amount of these charge carrier generating substances to the binder has no special limitation, but preferably 5 to 50% by weight because too much amount causes reduction of adhesiveness.

The CG layer of this invention is prepared by coating on a support as a thin layer by known coating method a coating solution prepared by mixing a solution of dye in methanol, ethanol, dimethylformamide, chlororform, etc. with a binder solution when the charge carrier generating substance is a dye or a coating solution prepared by adding a pigment powder to a binder solution and pulverizing the pigment by ball mill, ultrasonic dispersing, etc. when the substance is a pigment and then drying the coating. Thickness of the charge carrier generating layer has no special limitation, but when the layer is too thick, etching requires a long time and furthermore sensitivity is decreased. Thus, the thickness is preferably 0.1 to 2$\mu$.

The CT layer of this invention comprises a charge carrier transport substance and a binder containing a high molecular substance having a group soluble in alcohol solvents and/or alkali solvents.

Examples of the charge transport substances used in this invention are as follows:

(a) Aromatic tertiary amino compounds:

triphenylamine, diphenylbenzylamine, di($\beta$-naphthyl)benzylamine, diphenylcyclohexylamine, etc.

(b) Aromatic tertiary diamino compounds:

N,N,N',N'-tetrabenzyl-p-phenylenediamine, N,N,N',N'-tetrabenzylbenzidine, 1,1'-bis-(4-N,N-dibenzylaminophenyl)-ethane, 2,2-bis-(4-N,N-dibenzylaminophenyl)-butane, bis-(4-N,N-di-(p-chlorobenzylaminophenyl))-methane, 3,3-diphenyl allylidine-4,4'-bis(N,N-diethyl-m-toluidine), 4,4'-bis(di-p-tolylamino)-1,1,1-triphenylethane, etc.

(c) Aromatic tertiary triamino compounds:

4,4',4''-tris(diethylaminophenyl)methane, 4'-dimethylamino-4,4'-bis(diethylamino)-2,2'-dimethyltriphenylmethane, etc.

(d) Condensates:

Condensates of aldehyde and aromatic amines, reaction products of tertiary aromatic amines and aromatic halides, reaction products of poly-p-phenylene-1,3,4-oxadiazole, formaldehyde and condensation polyacylic compounds, etc.

(e) Heterocyclic compounds:

1,3,5-triphenyl-pyrazoline, 1-phenyl-3-(p-dimethylaminostyryl)-5-(p-dimethylaminophenyl)-pyrazoline, 1,5-diphenyl-3-styryl-pyrazoline, 1,3-diphenyl-5-styrylpyrazoline, 1,3-diphenyl-5-(p-dimethylaminophenyl)-pyrazoline, 3-(4'-dimethylaminophenyl)-5,6-di-(4''-methoxyphenyl)-1,2,4-triazine, 3-(4'-dimethylaminophenyl)-5,6-dipyridyl-1,2,4-triazine, 2-phenyl-4-(4'-dimethylaminophenyl)-quinazoline, 6-hydroxy-2,3-di(p-methoxyphenyl)-benzofuran, 2,5-bis-[4'-ethylamino-phenyl-(1')]-1,3,4-oxadiazole, 2-(4'-diethylaminophenyl)-6-methyl-benzothiazole, 2-(4'-diethylamino-styryl)-benzthiazole, 2,5-bis-[(4'-diethylaminophenyl)]-1,3,4-triazole, 2-vinyl-4-(4'-diethylaminophenyl)-5-(2'-chlorophenyl)oxazole, 2-(4'-chlorophenyl)4-(4'-diethylaminophenyl)-5-(2'-chlorphenyl)-oxazole, 2-(4'-diethylamino-phenyl)-6-methylbenzoxazole, 2-(4'-diethylamino-styryl)-benzoxazole, 1-methyl-2-(4'-diethylamino-phenyl)-benzimidazole, etc.

Furthermore, since the binder of the CT layer of this invention contains at least high molecular substance having a group soluble in alcohol solvents and/or alkali solvents, this layer can be etched with alcohol solvents and/or alkali solvents. As said high molecular substances, there may be used high molecular substances having acid anhydride group, carboxylic acid group, sulfonic acid group, sulfonimide group, etc. which are also used as binders for said CG layer and phenolic resins. However, when alcohol solvents are used for coating of CT layer, the CG layer is dissolved therein and both the layers are mixed with each other to result in no function-separated type complex layer type photosensitive materials. Thus, the same materials as single-layer photosensitive materials are formed and reduction of sensitivity is caused. Therefore, the binders for the CT layer are preferably those which are soluble in said etching solution and further soluble in ester solvents such as ethyl acetate, butyl acetate, etc., ketone solvents such as methylisobutyl ketone, etc., aromatic solvents such as toluene, xylene, etc. or mixed solvents thereof.

It is preferred not to add alcohol solvent, but if added, the amount is preferably less than 10% by weight of the solvents used and the layer should be rapidly dried. Of these high molecular substances having a group soluble in alcohol and/or alkali solvents those which contain the soluble group in substantially a small amount are especially preferred as binders for the CT layer in this invention because these substances are dissolved in solvents other than the alcohol solvents, too. For example, those which contain styrene-maleic anhydride in an amount of less than 50 mol % or those of half ester type are preferred. Furthermore, in the case of vinyl acetate-crotonic acid copolymer, (meth)acrylic acid ester-(meth)acrylic acid copolymer, and styrene-(meth)acrylic acid copolymer, those which contain monomers having carboxylic acid group in an amount of less than 50 mol % are preferred and those which have easily changeable solubility are preferred.

Amount of the binder to the charge carrier transfer substance in the CT layer has no special limitation, but is preferably 0.5 to 4 in weight ratio considering the balance of etching speed, photosensitivity, film strength, etc. Moreover, the binder may contain other high molecular substances insoluble in alcohol or alkali solvent, e.g., polystyrene, acrylic resins, etc. or electron attracting substances for controlling etching speed, increasing film strength and increasing photosensitivity.

The CT layer may be colored, but is preferably transparent in sensitive spectral region of the CG layer. Thickness of the CT layer has no special limitation, but is suitably 2 to 10μ considering the etching speed.

Any of known printing plate bases may be used as support in this invention. As examples of the supports, mention may be made of metal plates such as aluminum plate, zinc plate, magnesium plate, steel plate, etc., films or synthetic paper such as polyester, cellulose acetate, polycarbonate, polystyrene, polyamide, polypropylene, etc., coated papers such as resin coated paper, etc. However, such bases as having hydrophobic surface must be previously treated to render the surface hydrophilic because after formation of images, the photoconductive compound and the binder are removed by etching treatment and non-image areas must have hydrophilicity. Metal plates, especially aluminum plates are most preferred, but they are preferably subjected to surface treatments such as sand-graining treatment, alkali treatment, acid treatment, anodizing treatment, etc. Films are preferably coated with high molecular compounds having a relatively high hydrophilicity and subjected to crosslinking treatment or coated with a metal by vapor deposition or lamination. When an insulating base is used, the surface is preferably subjected to conductivity imparting treatment.

The electrophotographic complex layer type photosensitive material of this invention may be produced by coating an alcoholic solution of the composition of CG layer on the support by known method, drying the coated composition, further coating thereon a solution of the composition of CT layer and drying the coated composition. A toner image is produced on thus obtained electrophotographic complex layer type photosensitive material by electrophotographic process and then the surface of the material is subjected to etching treatment with alcohol solvent and/or alkali solvent to obtain the complex layer type lithographic printing plate of this invention.

The toners used for image formation may be either of dry type or wet type toners, but wet type toners used in liquid developing method are much more preferred for obtaining prints excellent in resolving power. Furthermore, in order for the materials being used as printing plates, it is necessary that the toners are hydrophobic and ink-receptive, have adhesiveness to the plates enough to stand printing and have resistance against etching with alkali or alcohols. As examples of toners which meet these conditions, mention may be made of styrene resins, acrylic resins, polyester resins, epoxy resins, etc. It is practically preferred to add to the toners a pigments or dyes for coloration and charge controlling agents as long as they do not give adverse effect on safety or fixability of the toners.

The printing plates of this invention can be obtained by forming a toner image on a printing original plate by electrophotography and thereafter subjecting unexposed portion to etching treatment with alkali solvent and/or alcohol solvent. As the alkalis, mention may be made of sodium hydroxide, potassium hydroxide, sodium carbonate, sodium silicate, sodium phosphate, potassium phosphate, ammonia, etc. Examples of the alcohols are lower alcohols or aromatic alcohols such as methanol, ethanol, propanol, benzyl alcohol, etc. and ethylene glycol, diethylene glycol, triethylene glycol, polyethylene glycol, cellosolves, etc.

The etching treatment can be accomplished with an aqueous alkali solution or alcohol alone, but use of amino alcohols such as monoethanolamine, diethanolamine, triethanolamine, etc. is preferred considering etching speed and safety and hygienic aspect and combination of amino alcohols and alcohols is most preferred from the points of resolving power and image reproducibility. Furthermore, preferably a small amount of surfactant is added to the etching solution for rapid etching. Water-washing treatment and treatment with a dilute aqueous acid solution after the etching treatment result in prevention of scumming in non-image areas at printing and excellent image reproducibility.

This invention will be further illustrated by the following examples.

EXAMPLE 1

On a mechanically grained and anodized aluminum plate of 0.3 mm thick were provided a CG layer of 0.8μ thick and a CT layer of 5μ thick of the following compositions in this order to make an electrophotographic complex layer type photosensitive material, namely, a complex layer type lithographic printing original plate.

| | |
|---|---|
| [CG layer coating liquid A-1] | |
| Rhodamine B | 1.0 g |
| 6/6,6-copolymer nylon | 8.5 g |
| Styrene-acrylic acid copolymer (monomer ratio 30:70) | 1.5 g |
| Methanol | 150 g |
| n-Butanol | 50 g |
| [CT layer coating liquid B-1] | |
| 2,5-bis-[4'-ethylamino-phenyl-(1')]-1,3,4-oxadiazole | 1 g |
| Half ester of styrene-maleic anhydride copolymer (monomer ratio 55:45) | 1.2 g |
| Butyl acetate | 10 g |

An image was formed on this complex layer type lithographic printing original plate with dry type toner by electrophotographic process and this plate was dipped in the following etching solution for 15 seconds to carry out etching treatment to obtain a complex layer type lithographic printing plate.

| [Etching solution C-1] | |
|---|---|
| Benzyl alcohol | 85 g |
| Monoethanolamine | 32 g |
| Sodium isopropylnaphthalenesulfonate | 18 g |
| Water | 1000 cc |

The resultant printing plate was washed with water and then the non-image areas were rendered hydrophilic with 2% aqueous phosphoric acid solution. This printing plate was then subjected to printing endurance test using AM-1250 offset printing machine to find that neither image loss nor scumming in non-image areas occurred even after printing of more than 50,000 impressions and clear prints were obtained.

For comparison, a coating liquid prepared by adding 2 cc of 1% solution of Rhodamine B in dimethylformamide to said coating liquid B-1 was coated on said aluminum plate to obtain a single-layer eleotrophotographic photosensitive material (Comparative Example 1). Separately, the coating liquid A-1 for CG layer from which the styrene-acrylic acid copolymer was omitted and the coating liquid B-1 were coated in this order on said aluminum plate in the same manner as in Example 1 to obtain a complex layer type photosensitive material (Comparative Example 2). These were employed as lithographic printing original plates. $E_{\frac{1}{2}}$ sensitivity (exposure amount required for reducing initial potential to $\frac{1}{2}$) and $E_{50}$ sensitivity (exposure amount required for reducing initial potential to 50 volts) of the plates of Example 1 and Comparative Example 1 were measured to obtain $E_{\frac{1}{2}}=30$ lux·second and $E_{50}=80$ lux·second for the plate of Example 1 while $E_{\frac{1}{2}}=50$ lux·second and $E_{50}=200$ lux·second for that of Comparative Example 2. This indicates that sensitivity of the plate of Comparative Example 1 decreased. Images were formed on the original plates of Comparative Examples 1 and 2 and they were subjected to etching treatment by dipping them in said etching solution. In the case of Comparative Example 1 the photosensitive layer remained in non-image area due to fogging and in the case of Comparative Example 2 the CG layer remained in non-image area and in both the cases scumming occurred in non-image areas at printing and clear prints were not obtained.

EXAMPLE 2

Coating liquids of the following compositions were prepared and a complex layer type lithographic printing original plate having a CG layer of 0.2μ thick and a CT layer of 4μ thick was obtained.

| [CG layer [liquid A-2] | |
|---|---|
| Ethyl Violet | 1.5 g |
| 6/6,6/11-copolymer nylon | 8.8 g |
| Methacrylic acid-butyl methacrylate copolymer (molar ratio 20:80) | 1.2 g |
| Methanol | 200 g |
| [CT layer coating liquid B-2] | |
| 4'-dimethylamino-4,4''-bis(diethylamino)-2,2''-dimethyltriphenylmethane | 1.0 g |
| Styrene-methacrylic acid copolymer (molar ratio 70:30) | 1.2 g |
| Butyl acetate | 8.0 g |
| Toluene | 2.0 g |

-continued

| | |
|---|---|
| Isopropyl alcohol | 1.0 g |

An image was formed on thus obtained complex layer type lithographic printing original plate with caps type 4R liquid toner by electrophotographic process and this plate was dipped in said etching solution C-1 for 15 seconds to subject it to etching treatment to obtain a complex layer type lithographic printing plate. When in the same manner as in Example 1, printing was carried out using this printing plate, there occurred neither scumming in non-image areas nor image loss and clear prints were obtained even after printing of 50,000 impressions.

For comparison, a coating liquid prepared by adding 2 cc of 1% ethanolic solution of Ethyl Violet to the coating liquid B-2 was coated on said aluminum plate to obtain a 5μ thick single-layer electrophotographic photosensitive material (Comparative Example 3) and a CG layer coating liquid A-2 from which the butyl methacrylate-methacrylic acid copolymer was omitted and coating liquid B-1 were coated in this order on said aluminum plate in the same manner as in Example 2 to obtain a complex layer type photosensitive material (Comparative Example 4). These was lithographic printing original plates. Sensitivities of the plates of Example 2 and Comparative Example 3 were measured to obtain $E_{\frac{1}{2}}=13$ lux·second and $E_{50}=45$ lux·second for Example 2 and $E_{\frac{1}{2}}=22$ lux·second and $E_{50}=120$ lux·second for Comparative Example 3. That is, sensitivity of the plate of Comparative Example 3 decreased.

Furthermore, images were formed on the original printing plates of Comparative Examples 3 and 4 in the same manner as in Example 2 and these plates were subjected to etching treatment by dipping them in said etching solution for one minute. In both the plates, the photosensitive layer remained in non-image areas, scumming in non-image areas occurred at printing and clean prints could not be obtained.

EXAMPLE 3

Coating liquids of the following compositions were prepared and a complex layer type lithographic printing original plate having a CG layer of 1μ thick and a CT layer of 4μ thick was made using said coating liquids.

| [CG layer coating liquid A-3] | |
|---|---|
| Copper phthalocyanine blue | 4.0 g |
| 6/6,6-copolymer nylon | 6.0 g |
| Styrene-maleic anhydride copolymer (molar ratio 50:50) | 2.0 g |
| Methanol | 120 g |
| Butanol | 30 g |

(This coating liquid was dispersed by ball milling for 24 hours.)

| [CT layer coating liquid C-3] | |
|---|---|
| 1,3-diphenyl-5-(p-diethylaminophenyl)-pyrazoline | 1.0 g |
| Phenolic resin (condensate of formalin and tert-butylphenol, molecular weight 1000) | 1.2 g |
| N,N'-diethylthiobarbituric acid | 0.1 g |
| Butyl acetate | 13 g |

Thus obtained complex layer type lithographic printing original plate was set in Diafax EP-11 type plate making machine (liquid developing type electrophotographic printing plate making machine manufactured by Mitsubishi Paper Mills Ltd.) to make a printing plate, which was subjected to etching treatment by dipping it in the following etching solution for 30 seconds to obtain a complex layer type lithographic printing plate.

| [Etching solution C-2] | |
|---|---|
| Sodium silicate (40% aqueous solution) | 100 g |
| Sodium hydroxide | 80 g |
| Benzyl alcohol | 20 g |
| Water | 1000 cc |

In the same manner as in Example 1, printing was carried out using thus obtained printing plate. Even after printing of 50,000 impressions neither image loss nor scumming occurred and clear prints were obtained.

For comparison, a coating liquid prepared by adding 4 g of copper phthalocyanine blue to the coating liquid B-3 and dispersing them by ball milling for 24 hours was coated on said aluminum plate to obtain a 5μ thick single-layer electrophotographic photosensitive material (Comparative Example 5) and the coating liquid A-3 from which the styrene-maleic anhydride copolymer was omitted and the coating liquid B-3 were coated in this order on said aluminum plate in the same manner as in Example 3 to obtain a complex layer type photosensitive material (Comparative Example 6), which were lithographic printing original plates. Sensitivities of the original plates of Example 3 and Comparative Example 5 were measured to obtain $E_{178}=20$ lux·second and $E_{50}=70$ lux·second for Example 3 and $E_{\frac{1}{2}}=30$ lux·second and $E_{50}=150$ lux·second for Comparative Example 5. That is, sensitivity of the original plate of Comparative Example 5 was inferior.

Furthermore, dark decay ratio of initial surface potential after 10 seconds of the plate of Example 3 was 95% while that of the plate of Comparative Example 5 was 65%, which was inferior to the former. Density of images formed by EP-11 on the plates of Comparative Example 5 was low, resistibility of toner images decreased and thus, lithographic printing plate was not obtained.

Furthermore, a printing plate was made from the original plate of Comparative Example 6 by EP-11 and subjected to etching treatment by dipping it in said etching solution for one minute. As in the case of Comparative Example 2, CG layer remained in non-image areas and scumming in non-image areas occurred during printing.

What is claimed is:

1. A method for making a complex layer type lithographic printing plate which comprises forming a toner image on an original printing plate having organic electrophotographic photosensitive layer by electrophotographic process, said photosensitive layer being a complex layer type photosensitive layer which comprises a charge carrier generating layer comprising a charge carrier generating substance and a binder mainly composed of a polyamide resin soluble in alcohol solvent and a high molecular substance having compatibility with said polyamide resin and having a group soluble in an etching solution mainly composed of alcohol solvent and/or an alkali solvent to accelerate dissolution in said etching solution and a charge carrier transport layer comprising a charge carrier transport substance and a high molecular substance having a group soluble in an etching solution mainly composed of alcohol solvent and/or alkali solvent and thereafter treating non-image area other than the toner image area with the etching solution.

2. A method for making a complex layer type lithographic printing plate according to claim 1, wherein the polyamide resin of the binder for the charge carrier generating layer is copolymer nylon.

3. A method for making a complex layer type lithographic printing plate according to claim 1 wherein the high molecular substance of the binder for the charge carrier generating layer is one having acid anhydride group, carboxylic acid group, sulfonic acid group or sulfonimide group.

4. A method for making a complex layer type lithographic printing plate according to claim 1 wherein the charge carrier generating substance is an organic pigment or sensitizing dye.

5. A method for making a complex layer type lithographic printing plate according to claim 1 wherein the charge carrier transport substance is an aromatic tertiary amino compound, an aromatic tertiary diamino compound, an aromatic tertiary triamino compound, a condensate or a heterocyclic compound.

6. A method for making a complex layer type lithographic printing plate according to claim 1 wherein the high molecular substance contained in the binder for the charge carrier transfer layer is one having acid anhydride group, carboxylic acid group, sulfonic acid group or sulfonimide group or a phenolic resin.

7. An original printing plate having organic electrophotographic photosensitive layer on a support for complex layer type lithographic printing plate on which a toner image is formed, said photosensitive layer comprising a charge carrier generating layer comprising a charge carrier generating substance and a binder mainly composed of a polyamide resin soluble in alcohol solvent and a high molecular substance having compatibility with said polyamide resin and having a group soluble in an etching solution mainly composed of alcohol solvent and/or alkali solvent to accelerate dissolution is said etching solution and a charge carrier transport layer comprising a charge carrier transport substance and a high molecular substance having a group soluble in an etching solution mainly composed of alcohol solvent and/or alkali solvent.

8. A printing method which comprises carrying out printing with the complex layer type lithographic printing plate made by the method of claim 1.

* * * * *